US005570160A

United States Patent [19]

Miwa et al.

[11] Patent Number: 5,570,160

[45] Date of Patent: Oct. 29, 1996

[54] IMAGE FORMING APPARATUS HAVING A ROTATABLE PHOTORECEPTOR

[75] Inventors: Tadashi Miwa; Isao Matsuoka; Sakaho Matsunaga; Takayuki Miyamoto, all of Hachioji, Japan

[73] Assignee: Konica Corporation, Tokyo, Japan

[21] Appl. No.: 495,708

[22] Filed: Jun. 27, 1995

[30] Foreign Application Priority Data

Jul. 14, 1994 [JP] Japan ..... 6-162228
Jul. 14, 1994 [JP] Japan ..... 6-162229

[51] Int. Cl.[6] ..... G03G 15/00; G03G 21/00

[52] U.S. Cl. ..... 355/200; 355/211

[58] Field of Search ..... 355/200, 210, 355/211, 326, 212, 327

[56] References Cited

U.S. PATENT DOCUMENTS

| | | | |
|---|---|---|---|
| 4,835,582 | 5/1989 | Kasahara et al. . | |
| 5,019,861 | 5/1991 | Surti | 355/200 |
| 5,111,242 | 5/1992 | Tanimoto et al. | 355/200 |
| 5,132,728 | 7/1992 | Suzaki et al. | 355/200 |
| 5,444,525 | 8/1995 | Takahashi et al. | 355/327 X |
| 5,488,399 | 1/1996 | Mitomi et al. | 355/327 X |
| 5,508,784 | 4/1996 | Matsuoka et al. | 355/200 |

FOREIGN PATENT DOCUMENTS

| | | |
|---|---|---|
| 0251693 | 1/1988 | European Pat. Off. . |
| 0586869A3 | 3/1994 | European Pat. Off. . |
| 0585897A1 | 3/1994 | European Pat. Off. . |
| 5-158291 | 6/1993 | Japan . |

OTHER PUBLICATIONS

Abstract, Derwent World Patent Index, Acc. No. 96–101221 for JP–A–08006170, Jan. 1996.

Abstract, Derwent World Patent Index, Acc. No. 95–338443 for EP–A2–675413, Oct. 1995.

Abstract, Derwent World Patent Index, Acc. No. 94–104245 for JP–A–06051676, Feb. 1994.

*Primary Examiner*—R. L. Moses

*Attorney, Agent, or Firm*—Frishauf, Holtz, Goodman, Langer & Chick, P.C.

[57] ABSTRACT

An image forming apparatus for forming a toner image. The apparatus includes: a photoreceptor drum, having a side surface and a circumferential surface, for forming an image on the circumferential surface: a driving means for driving the photoreceptor drum; a sliding member for decreasing steady state speed fluctuations of the photoreceptor drum; and an elastic member for pressing the sliding member onto the side surface of the photoreceptor drum.

27 Claims, 16 Drawing Sheets

IMAGE FORMING APPARATUS HAVING A ROTATABLE PHOTORECEPTOR

BACKGROUND OF THE INVENTION

The present invention relates to a driving apparatus for a photoreceptor of an image forming apparatus in which an image is formed by a digital method in an electrophotographic method, and specifically relates to an image forming apparatus in which a plurality of developing devices are arranged around the photoreceptor, and a color toner image is formed by superimposing a plurality of mono-color images on each other, which are developed by the developing devices.

In copiers or printers using the electrophotographic method, an image is obtained by the following operations: a cylindrical or belt-shaped photoreceptor is rotated; an electrostatic latent image is formed on the surface of the rotating photoreceptor; toners are adhered onto the latent image during development and a toner image is formed; the toner image is transferred onto a transfer material; and the image on the transfer material is fixed.

In the above image forming apparatus, when fluctuations in the speed of the rotating photoreceptor are caused for any reason, jittering occurs and unevenness results on the outputted image. This problem is conspicuous in the digital type electrophotographic technology in which image data is written by scanning of a semiconductor laser. Speed fluctuations in the rotation of the photoreceptor cause speed fluctuations in the data writing system in the subsidiary scanning direction, and thereby, minute displacement is caused in the interval between written lines, resulting in severely lowered image quality.

Specifically, in a color image forming apparatus, in which a plurality of developing devices are arranged around the photoreceptor, and a color toner image is formed when a plurality of mono-color images are superimposed on each other, the color tone of the secondary color, which is formed by more than 2 toner layers, is determined by an appropriate adhered amount of each toner of each layer. Accordingly, accuracy of the position of each layer is essentially required. That is, in the image forming process after the second toner layer, exposure by the semiconductor laser, or the like, is carried out from above the toner layer which is already formed on the photoreceptor. Therefore, although the exposure should be carried out onto the toner layer, the surface of the photoreceptor, on which no toner layer yet exists, is exposed when the position to be exposed is displaced by the adverse influence caused by speed fluctuations of the photoreceptor. At this time, the absolute value of the surface potential of the photoreceptor is lowered, compared with the case where the toner layer already exists. Accordingly, the adhered amount of toner after development is increased more than in the case where the exposure is carried out from above the toner layer. As a result, the color tone in this portion deviates from the desired value. In many cases, in digital type image output apparatus, an image is composed of lines which are formed of a series of dots. In this case, a difference in the latent image forming process is caused between the portion in which the interval of lines to be exposed is decreased by speed fluctuations of the photoreceptor, and the portion in which the interval of lines to be exposed is increased. Accordingly, the electric potential distributions on the photoreceptor are different from each other, resulting in large differences between toner adhered amounts. This causes uneven color of the image in the rotational direction of the photoreceptor. The color image quality is severely lowered for the this reason.

On the other hand, in the conventional designs of drive systems in copiers or printers, it is a major object to determine an appropriate position of the subject to be driven, considering available space, while satisfying the line speed, or the number of rotations which are derived from specifications of the product. That is, the following are a matter of large concern: by what method is the mechanical power supplied from the power source to be transmitted to the subject to be driven; or what mechanical components are to be selected for power transmission. Accordingly, when jittering or unevenness due to rotation occurs in the final product, the causes of unevenness are investigated, and the following countermeasures are considered: the drive shaft bearing of the photoreceptor is replaced with a sintered one; a flywheel is connected to the drive shaft of the photoreceptor; a brake, including a spring and a friction member, is attached onto the rotational shaft of the photoreceptor; accuracy of gears is increased; or helical gears having various twist angles are used.

As described above, it is essential to increase the driving accuracy of the photoreceptor drum in order to increase the image quality in the digital image formation.

There are various factors by which the driving accuracy of the photoreceptor is deteriorated. As the above-described factors relating to the driving system of the photoreceptor, which mainly control the drive of the photoreceptor itself, the following factors are described: driving unevenness of the main motor; eccentricity of the motor shaft; and a specific frequency component of the specific structure of the motor. Concerning the gear train in the driving system, the fluctuations in one tooth or one rotation of gear caused by inaccuracy of gears, specifically, the accuracy of the tooth form, the accuracy of the tooth trace, the eccentricity of the gear, or the like, are listed. Further, also in the case where the driving system is composed of a motor and gears, the positional relationship of the motor shaft and gear shafts, specifically, the distance between shafts directly affects an amount of backlash of gears, and errors in shaft alignment cause vibrations at points of engagement between gears.

The driving accuracy of the photoreceptor greatly affects not only the driving system, but also the case where peripheral units are operated. One of the units which have a major affect on the system, is the developing unit. The developing unit has a moving portion for rotating the developing sleeve and the mixing screw at relatively high speed, and has a driving system for driving the moving portion independently or in combination with other units. In cases where the distance between the developing unit and the photoreceptor is determined by applying a member (a roller) to the surface of the photoreceptor, the vibrations generated in this driving system are directly transmitted to the photoreceptor through this member, and adversely affect the driving accuracy of the photoreceptor. Further, in also a development driving system, vibrations are generated depending on engagement conditions of the developing unit with a coupling portion of the driving system. This phenomena is due to the amount of backlash of coupled gears and mis-alignment of the driving shaft. The transmission ratio of the vibrations, generated in the developing unit and transmitted to the photoreceptor, changes depending on a supporting method of the developing unit. When the unit is fairly firmly supported, the degree of vibration transmitted to the photoreceptor is small. When the unit is inadequately supported, the unit itself vibrates at that position, and vibrations at each portion are transmitted to the photoreceptor without attenuation.

Moving portions are provided in not only the developing unit, but also in the cleaning unit, the transfer unit and the conveyance unit, or the transfer and conveyance unit which is integrally composed of the transfer unit and the conveyance unit. Accordingly, vibrations are inevitably generated. These vibrations are transmitted through the photoreceptor cartridge or the frame of the photoreceptor, which are provided near the above-described moving portions, and further, through the main body frame to the photoreceptor. Fluctuations of frequencies of vibrations are transmitted to the photoreceptor or the driving system of the photoreceptor, resulting in reduction of the driving accuracy of the photoreceptor.

As described above, when deterioration of the driving accuracy of the photoreceptor is generated, displacement of lines is generated, and changes in image density and color unevenness are thereby caused.

The above-described problems have been solved or improved in the present invention. An object of the present invention is to provide an image forming apparatus in which the speed fluctuation of the photoreceptor is effectively reduced, and thereby, the photoreceptor is always driven at a stable rotation speed, when a very simple device is provided in the apparatus.

SUMMARY OF THE INVENTION

The above-described object is accomplished by an electrophotographic image forming apparatus, according to the first example, comprising: a photoreceptor; a cartridge for accommodating the photoreceptor therein; a driving portion for transmitting a driving force to the photoreceptor; and a sliding member, which is formed of a viscoelastic layer, 2 layers of the viscoelastic layer and a surface layer for protecting the viscoelastic layer, or 3 layers of the viscoelastic layer, a base layer for reinforcing the viscoelastic layer, and the surface layer, the sliding member being provided on either of the side surface of the photoreceptor, or the inner surface of the cartridge opposed to the side surface of the photoreceptor, wherein the surface of the sliding member slides on the inner surface of the cartridge, which is opposed to the side surface of the photoreceptor, or on the side surface of the photoreceptor, when the photoreceptor is driven.

Alternatively, the above-described object is accomplished by an electrophotographic image forming apparatus, according to the second example, comprising: a photoreceptor; a cartridge for accommodating the photoreceptor therein; a driving portion for transmitting a driving force to the photoreceptor; and a sliding member, which is in pressure-contact with an elastic member, is provided on either the side surface of the photoreceptor or the inner surface of the cartridge, which is opposed to the side surface of the photoreceptor, wherein the sliding member slides on the inner surface of the cartridge, which is opposed to the side surface of the photoreceptor, or on the side surface of the photoreceptor, when the photoreceptor is driven.

In the second example of the present invention, the sliding member is in pressure-contact with the photoreceptor by the force of a metallic elastic member, and attenuation effects are generated by a friction force generated when the photoreceptor is rotated, so that vibrations of the photoreceptor are suppressed and thereby, speed fluctuations are decreased.

Although the metallic elastic member has small viscosity and therefore, the attenuation effects due to the viscosity are smaller, creep deformation is smaller than that of the viscoelastic member, so that a stable pressing force is obtained.

On the other hand, as a sliding member, a member having a higher attenuation factor is used so that the friction force against the photoreceptor is effectively converted into an attenuation action.

That is, in the second example, functions of the sliding member are divided into a function to supply a pressing force and a function to supply a friction force so that a stable braking action is obtained. A material having excellent durability and stability is used for the respective functions so that suppressing effects for the speed fluctuations of the photoreceptor are maintained.

FIG. 14(*a*) shows a power spectrum of speed fluctuations of the driving system by conventional photoreceptor driving technology. In the drawing, fluctuation components according to a single rotation of a motor and those according to an individual tooth of a gear, are shown with sharp peaks. This resonance area has a good correspondence with the frequency response function (transfer function) of the photoreceptor driving system shown in FIG. 14(*b*). This condition is clearly shown in FIG. 14(*c*) in which the above 2 drawings are superimposed on each other.

FIG. 15(*a*) shows the form of the frequency response function of the photoreceptor driving system, in the structure of the first and the second examples according to the present invention. In the drawing, the form of peaks of the function becomes smaller. This shows that the sensitivity with respect to fluctuation components in the frequency response area shown in the drawing is smaller than that of the original driving system shown in FIG. 14(*a*). FIG. 15(*b*) shows a power spectrum of the speed fluctuation in the driving system according to the present invention. Although several peaks of specific frequencies are shown in the drawing, fluctuation components as shown in FIG. 14(*a*) are almost eliminated, and resonance phenomena are also eliminated.

As can be seen from the image samples, line-shaped uneven density in the subsidiary scanning direction and uneven color, which are seen in the driving system shown in FIG. 14(*a*), are reduced to a level, at which this unevenness can not almost be discriminated, in the driving system shown in FIG. 15(*b*). This clearly shows the effectiveness of the present invention in practical use. Specifically, the fluctuation component to be eliminated by the present invention is the steady state speed fluctuation generated from the driving system, and this speed fluctuation is much smaller than the load fluctuation due to temporarily applied loads on the driving system. Generally, in a digital type image forming apparatus, this steady state speed fluctuation is about 8 to 10%, however, this speed fluctuation can easily be suppressed to lower than 3% by the present invention. Further, in a color image forming apparatus, the present invention can suppress this steady state speed fluctuation still lower to less than 1% in order to meet the required high quality image.

BRIEF DESCRIPTION OF THE DRAWINGS

FIGS. 12(*d*), 12(*e*) and 12(*f*) are sectional views of main portions showing examples of the arrangement of the sliding member according to the second example.

DETAILED DESCRIPTION OF THE INVENTION

Figure 1:
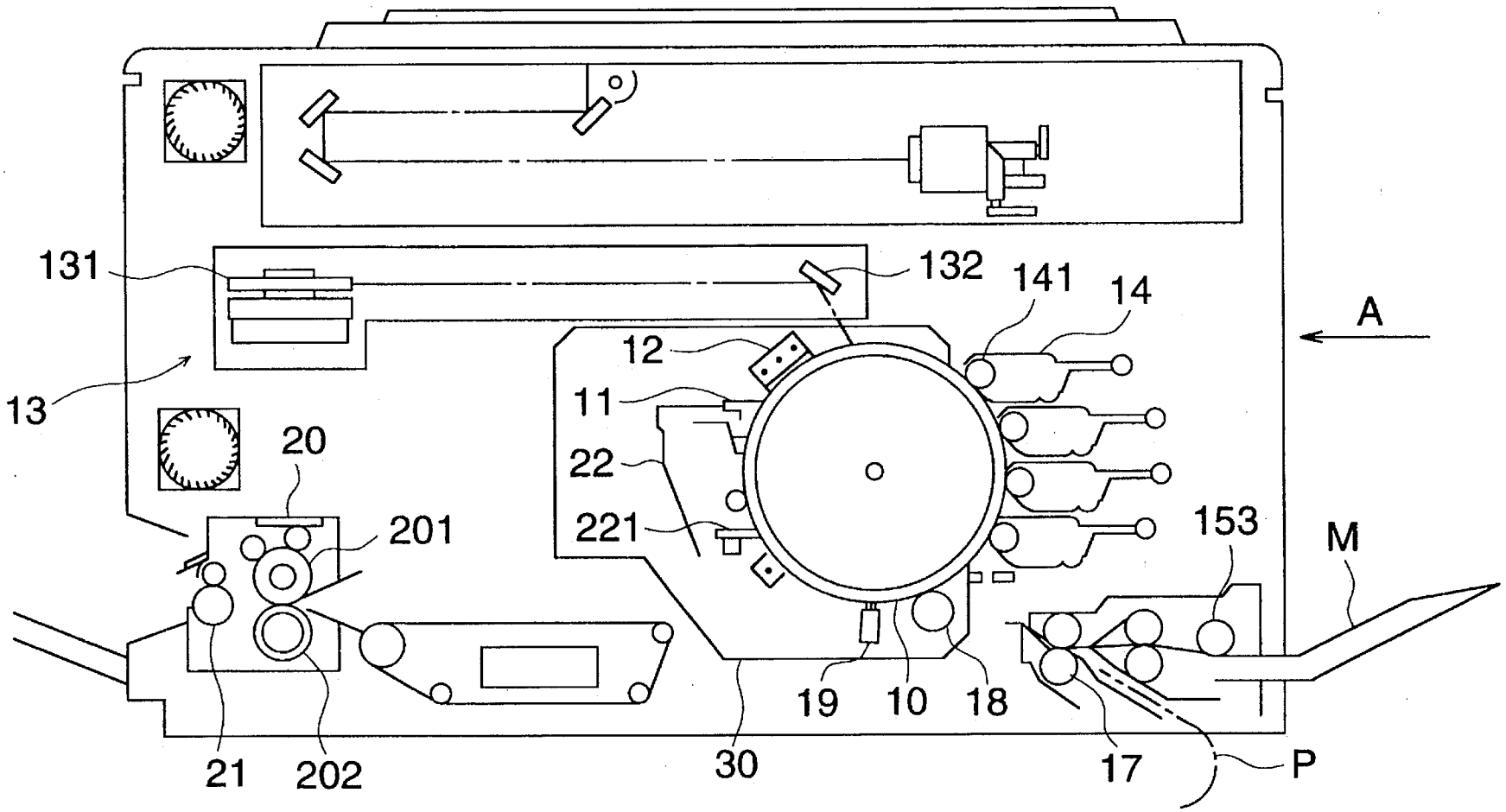
FIG. 1 is a sectional structural view of an image forming apparatus of the present invention.

Referring to FIGS. 1 through 8, a structure and its operation will be described below prior to the explanation of an example of the present invention.

In the drawings, numeral 10 is a photoreceptor drum which serves as an image carrier, on which an OPC photoreceptor is coated, and which is electrically grounded and rotated clockwise. Numeral 12 is a scorotron charger which uniformly charges the peripheral surface of the photoreceptor drum 10 to a potential voltage level of $V_H$ by a corona discharge using a grid, whose potential voltage is maintained to $V_G$, and a corona discharge wire. Before the charge by the scorotron charger 12, exposure is carried out on the peripheral surface of the photoreceptor drum by a PCL11, in which a light emitting diode, or the like, is used, so that the peripheral surface of the photoreceptor drum is discharged in order to erase any hysteresis of previous printing images on the photoreceptor.

After uniform charging onto the photoreceptor, image exposure is conducted by an image exposure means 13 according to an image signal. The image exposure means 13 performs the following operations: a laser diode, not shown, is used as a light source for a laser beam; the laser beam passes through a rotating polygonal mirror 131, an fθ lens, or the like; the optical path of the laser beam is bent by a reflection mirror 132; and scanning is carried out. Then, a latent image is formed when the photoreceptor drum 10 is rotated (subsidiary scanning). In this example, the exposure is carried out onto a character image portion, and a reversal latent image is formed such that the potential voltage of the character image portion is a potential voltage of $V_L$, which is lower than that of other portions.

Developing devices 14, in which developer composed of respective toners of yellow (Y), magenta (M), cyan (C) and black (K), and carriers is accommodated, are provided around the photoreceptor drum 10. Initially, the first development is carried out by a rotating developing sleeve 141 inside of which magnets are included. The developer is composed of: carrier in which ferrite is used as a core, and in which insulating resin is coated on the core; and toner in which polyester is used as a major material, and in which pigment corresponding to a color, a charge control agent, silica, titanium oxide, etc., are added to the major material. The layer thickness of the developer is regulated between 100 to 600μ m by a layer forming means on the developing sleeve 141, and the developer is conveyed to the development area.

A gap between the developing sleeve 141 and the photoreceptor drum 10 in the development area is set from 0.2 to 1.0 mm, which is larger than the layer thickness of the developer. An AC bias voltage $V_{AC}$ and a DC bias voltage $V_{DC}$ are superimposed on each other and applied onto the gap. Since $V_{DC}$, $V_H$ and the toner have the same polarity, the toner, which is triggered by $V_{AC}$ so as to separate from the carrier, does not adhere to the $V_H$ portion, the potential voltage (absolute value) of which is higher than $V_{DC}$, and adheres to the $V_L$ portion, the potential voltage of which is lower than $V_{DC}$, and the image becomes visible (reversal development).

After image formation of the first color has been completed, the sequence enters into the second color image forming process. The uniform charging operation by the scorotron charger 12 is carried out again, and a latent image according to the second color image data is formed on the photoreceptor by the image exposure means 13. At this time, discharge, which has been carried out in the first color image forming process by the PCL11, is not carried out because the toner, adhered to the first color image portion, scatters when the surrounding potential voltage is suddenly lowered.

On the photoreceptor, the potential voltage of which has again become $V_H$ along the entire peripheral surface of the photoreceptor drum 10, the same latent image as the first color is formed on a portion on which the first color image does not exist, and is developed. However, in a portion in which development is again carried out on a portion having the first color, light shielding due to the first adhered color toner is carried out, and a latent image having the potential voltage of $V_M'$ is formed by the toners own electric charge. Then, the latent image is developed corresponding to the voltage difference between $V_{DC}$ and $V_M'$. In the portion on which the first color and the second color are superimposed, when the first color is developed after the latent image having the voltage VL has been formed, the visual color balance between the first color and the second color is lost. Accordingly, sometimes, the exposure amount of the first color is reduced, and an intermediate potential voltage VM having the relationship of $V_H > V_M > V_L$ is adopted.

In the cases of the third and the fourth colors, the same image forming process as that of the second color is carried out, and a four-color latent image is formed on the peripheral surface of the photoreceptor drum 10.

On the other hand, the recording sheet P, conveyed from the sheet feed cassette 15 through a semi-circular roller 16, is temporarily stopped. Then, the recording sheet P is fed to a transfer area by rotations of a sheet feed roller 17 in timed relationship with a transfer operation.

In the transfer area, a transfer roller 18 comes into pressure-contact with the peripheral surface of the photoreceptor drum 10 in timed relationship with the transfer operation, and the recording sheet P, which has been fed as described above, is sandwiched between the transfer roller 18 and the peripheral surface of the photoreceptor drum 10. Then, a collective multi-color image is transferred onto the recording sheet.

Next, the recording sheet P is discharged by a separation brush 19 which is almost simultaneously in pressure-contact with the peripheral surface of the photoreceptor drum 10, separated from the peripheral surface of the photoreceptor drum 10, and conveyed to a fixing device 20. Toner is fused and adhered onto the recording sheet P by heat and pressure of a thermal roller 201 and pressure roller 202, and then, the recording sheet P is discharged outside the apparatus through a pair of sheet delivery rollers 21. The above-described transfer roller 18 and the separation brush 19 are withdrawn from the peripheral surface of the photoreceptor drum 10 after the recording sheet P has passed, and are ready for the next toner image formation.

Residual toner on the photoreceptor drum 10, from which the recording sheet P has been separated, is removed and the surface of the photoreceptor drum 10 is cleaned by the pressure-contact of a blade 221 of a cleaning unit 22. The photoreceptor drum 10 is discharged again by the PCL11, charged again by the charger 12, and enters into the next image formation process. In this connection, the blade 221 is immediately withdrawn from the peripheral surface of the photoreceptor drum 10 after the photoreceptor surface cleaning.

Figure 2:
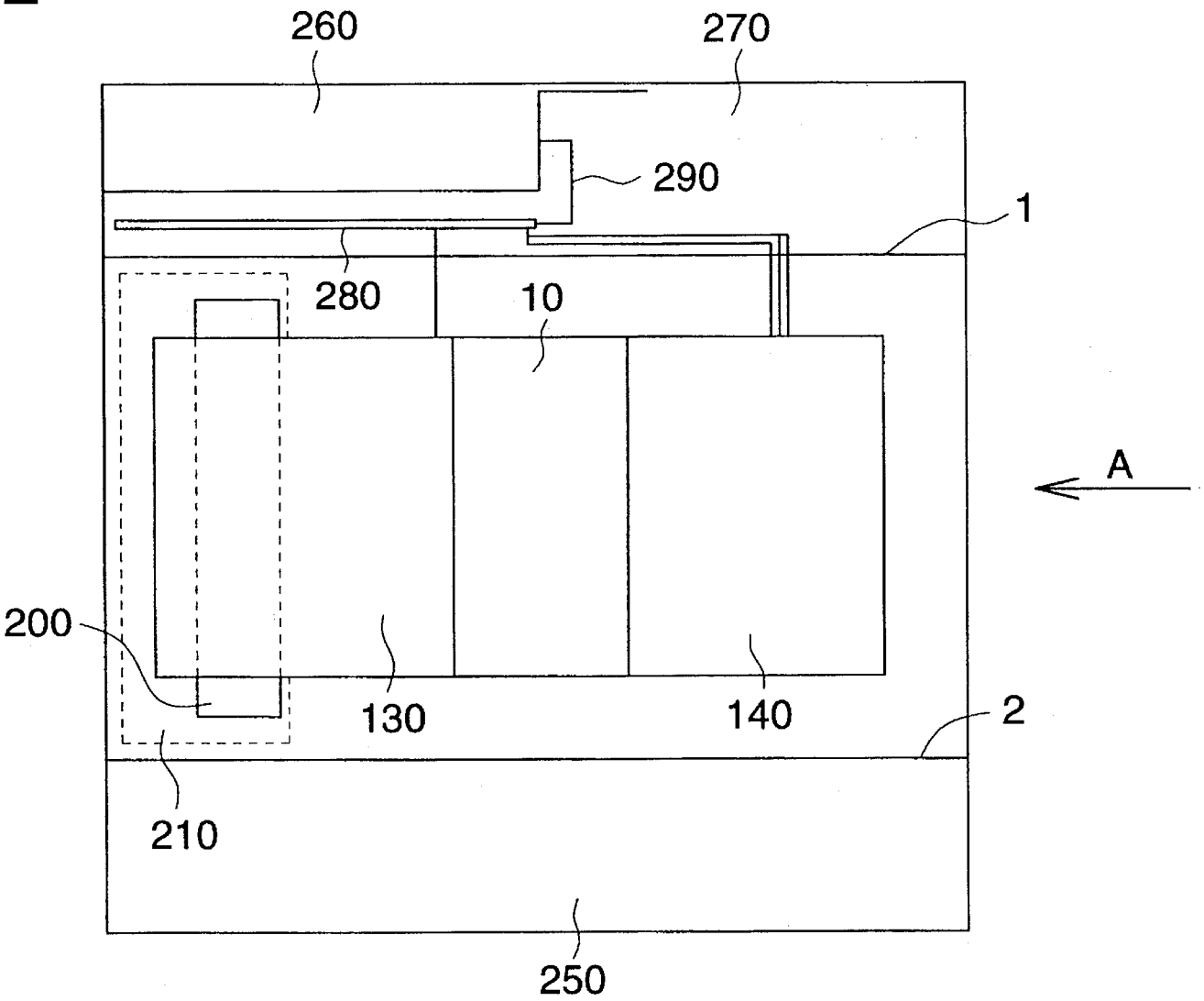
FIG. 2 is an illustration showing a layout of units in the apparatus.

FIG. 2 is a plan view showing the layout of each unit, of which the apparatus is composed, and the side, shown by an arrow mark, corresponds to the front of the apparatus, that is, the operation side.

The apparatus main body has two vertical side panels 1 and 2. A writing unit 130 which is an image exposure means 13, the photoreceptor drum 10, a developing unit 140 in which a plurality of developing devices 14 are housed, a unit 200 including a fixing device 20, and a DC power source unit 210 are installed between these vertical side panels. On the other hand, a drive system 270, a printer formatter 260 for decoding printer commands, and control boards 280 for sequence control of mechanical operations are housed outside the side panel 1. A toner box 250, which is connected to each developing device 14 in the developing unit, is housed outside the side panel 2.

Since the photoreceptor drum 10 and the developing unit 140 are positioned near the operation side of the apparatus, the apparatus can be structured such that the photoreceptor drum 10 and the developing unit 140 are pulled out of the front of the apparatus by a simple operation. Further, when the upper portion of the main body is opened, it is possible for the drum frame to be pulled out to a predetermined position so that jam processing can be carried out at a transfer position, without need to pull out the photoreceptor drum 10 and the developing unit 140 from the main body.

Further, jam processing in the sheet feed section can be carried out when the sheet feed cassette 15, which is housed in the lower portion of the photoreceptor drum 10 and the developing unit 140, is removed from the apparatus. Still further, jam processing in the sheet delivery section can be carried out when the apparatus is structured such that the rear surface of the apparatus can be opened.

Features of functions and performance of each unit, of which the image forming section of the apparatus is composed, will be described below.

Photoreceptor

The photoreceptor drum 10 is attached to and detached from the apparatus main body under the condition that the photoreceptor drum 10 is integrally housed in a cartridge 30 together with the charger 12, the transfer roller 18 and the cleaning unit 22.

Figure 3:
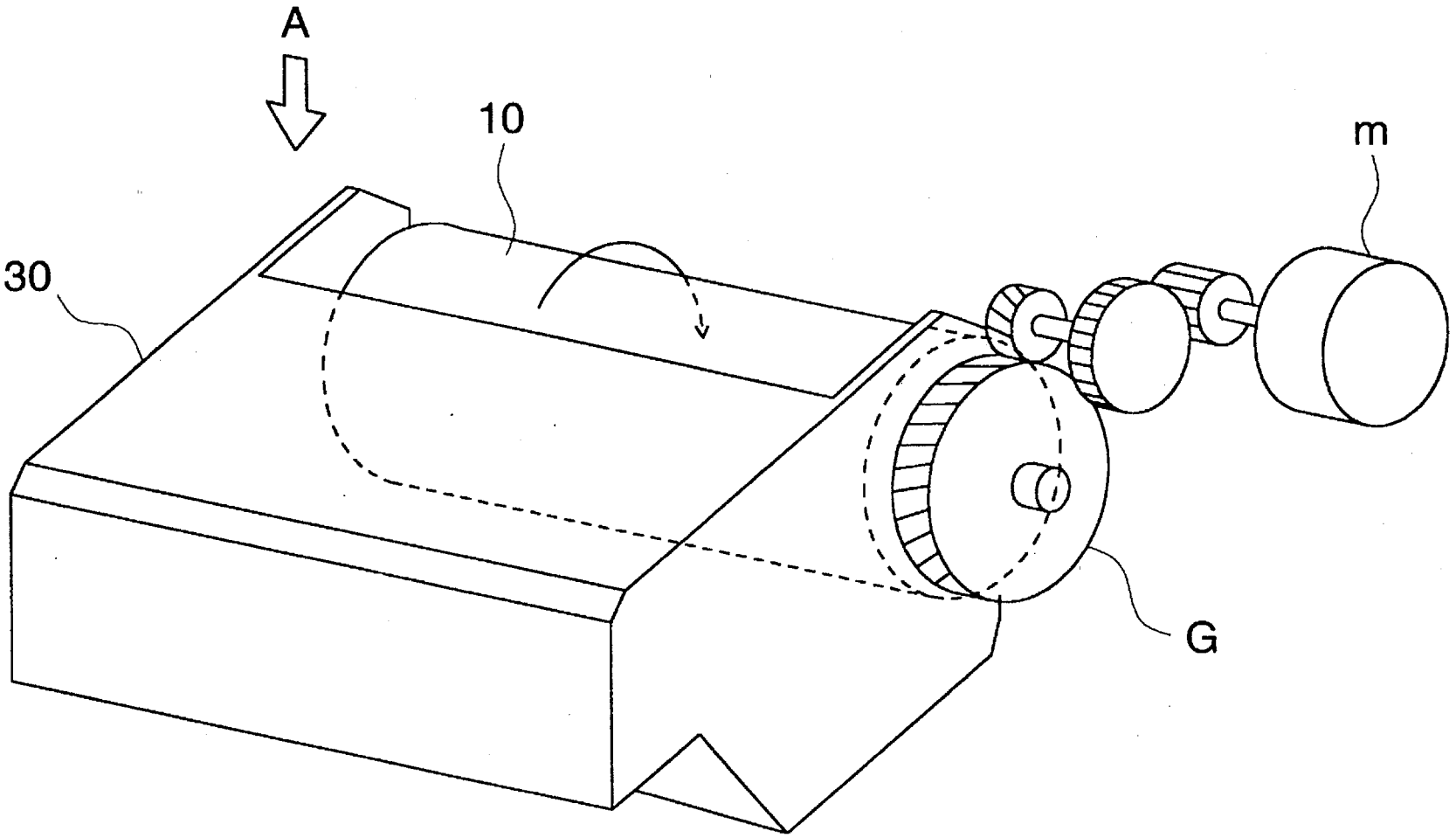
FIG. 3 is a perspective view showing the driving mechanism for a photoreceptor drum.

A rotation shaft, which is integrated with the photoreceptor drum 10, is supported by bearings in both side walls of the cartridge 30. When the cartridge 30 is installed, the shaft of the photoreceptor drum 10 is connected to a helical gear G, whose driving source is a motor m as shown in FIG. 3, and is rotated clockwise at a predetermined speed while the shaft is being thrust in the axial direction.

The OPC photoreceptor on the peripheral surface of the photoreceptor drum 10 is uniformly charged by the scorotron charger 12 due to the stable rotation of the photoreceptor drum 10. At the time of charging, the potential voltage of the grid is controlled, so that the charging potential voltage is stabilized. As an example, specifications and charging conditions of the photoreceptor are set as follows:

Photoreceptor: OPC ϕ120 line speed 100 mm/sec negatively charged

Charging conditions: charging wire: a platinum wire (clad or alloy) is preferably used. $V_H$_850 V, $V_L$_50 V

Image Exposure

Figure 4:
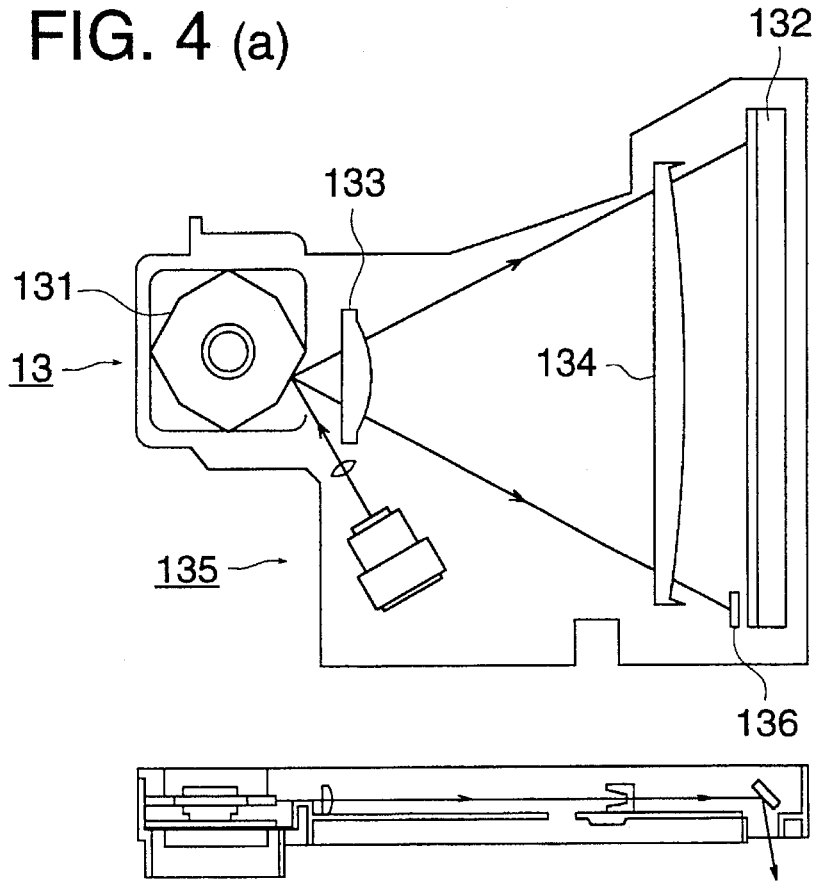
FIGS. 4(*a*) and 4(*b*) are illustrations showing an optical system of an image exposure means.
Figure 4:
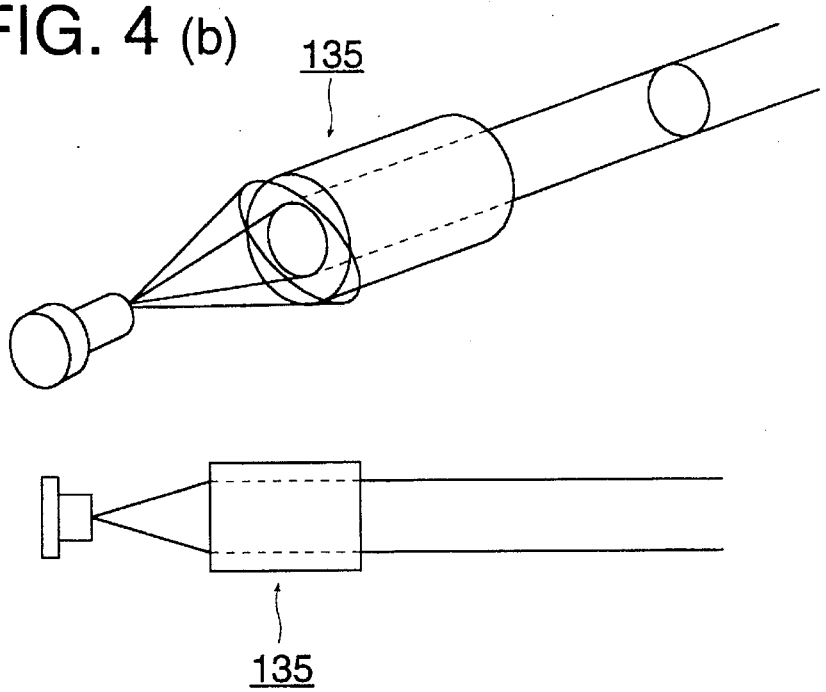

FIG. 4(*a*) is a plan view of a layout of the image exposure means 13 and its side view.

FIG. 4(*b*) is an illustration of a semiconductor laser unit 135 which is used for the image exposure means 13.

The OPC photoreceptor on the peripheral surface of the photoreceptor drum 10 is negatively charged by the charger 12, and after that, it is exposed by irradiation of the semiconductor laser unit 135 of the image exposure means 13, after which an electrostatic latent image is formed.

Image data outputted from the formatter 260 is sent to a laser diode (LD) modulation circuit. When the LD of the semiconductor laser unit 135 irradiates corresponding to the modulated image signal, the light beam is projected onto a polygonal mirror 131 through cylindrical lens 134, while each scanning line is synchronized by a beam index 136.

The light beam is reflected for scanning by the polyhedron of the polygonal mirror 131, and the shape of the scanning beam is corrected by an fθ lens 133 and a cylindrical lens 134. After that, the corrected light beam exposes the photoreceptor through a reflection mirror 132 for primary scanning, and an electrostatic image is formed.

The beam diameter of the laser beam is reduced by an optical system so that resolving power of the laser beam can be the same as that of 600 DPI. Accordingly, to obtain high quality images, it is necessary to reduce the particle size of the toner. In this example, toner with a particle size of 8 μm is used for each color. However, because the quality of black characters is most important for consumers, a smaller particle size toner (7 to 11μm) is preferable for black toner.

As an example of the optical system for the image exposure, the following structure is used.

Polygonal mirror: a hexahedron, the number of rotations: 23600 rpm, an air bearing is used.

Focal distance of the lens: f=140 mm Dot-clock: 20 MHz
Beam diameter: approximately 60×80μm

Development

Figure 5:
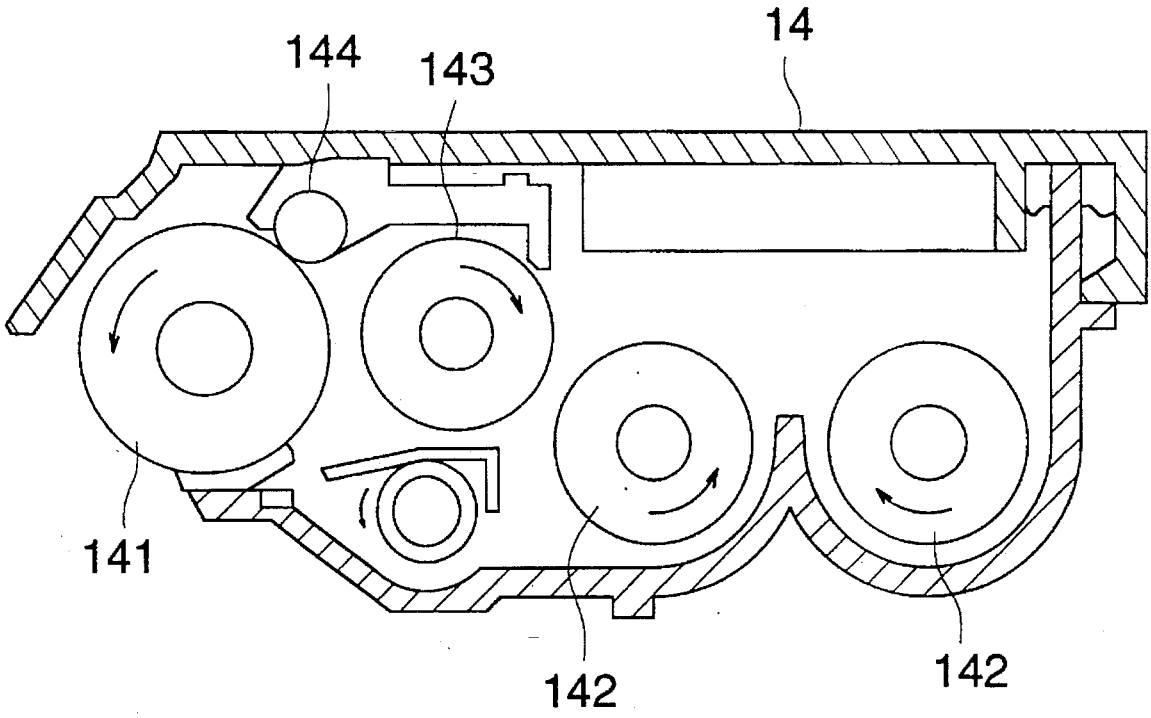
FIG. 5 is a sectional structural view of a developing device.

FIG. 5 shows the structure of the developing device 14. In FIG. 5, toner supplied from the toner box 250 in FIG. 2 drops into the right end portion of the developing device, is stirred and mixed with carrier by a pair of stirring screws 142 which rotate in opposite directions, and the toner is then charged in a predetermined charging amount (Q/M).

On the other hand, toner density is detected by the magnetic detection method, the supply amount of toner is controlled according to the output frequency of the sensor, and the density of toner is controlled to about 5 to 7%.

The stirred 2-component developer is conveyed by the supply roller 143 to the developing sleeve 141, and the thickness of the developer layer is regulated to be thin by the layer thickness regulating member 144. Then, the developer is conveyed to the developing area of the photoreceptor drum 10, and the reversal development of the electrostatic latent image is carried out under the following conditions:

Development gap: 0.5 mm

Conveyed amount of toner: 20 to 30 $mg/cm^2$

Developing bias voltage (AC): 2 KV, 8 KHz (DC): −750 V

Rotational direction of the developing sleeve: the same direction as that of the photoreceptor drum Image density adjustment: control of the number of rotations of the developing sleeve, or developing bias voltage control (the reference plate is formed on the photoreceptor by a laser beam, the reflection density is measured after development, and the image density is adjusted.)

Toner density control: the magnetic detection method

In this connection, although not shown in the drawing, when a toner bottle, which is loaded into the toner box, is used without additional processing as a toner hopper, the following advantages can be obtained. The size of the toner supplying apparatus can be made compact, and its structure is simplified. Simultaneously, when the toner bottle is made of a semitransparent material, the remaining amount of toner can be easily checked visually.

Sheet Feeding

Figure 6:
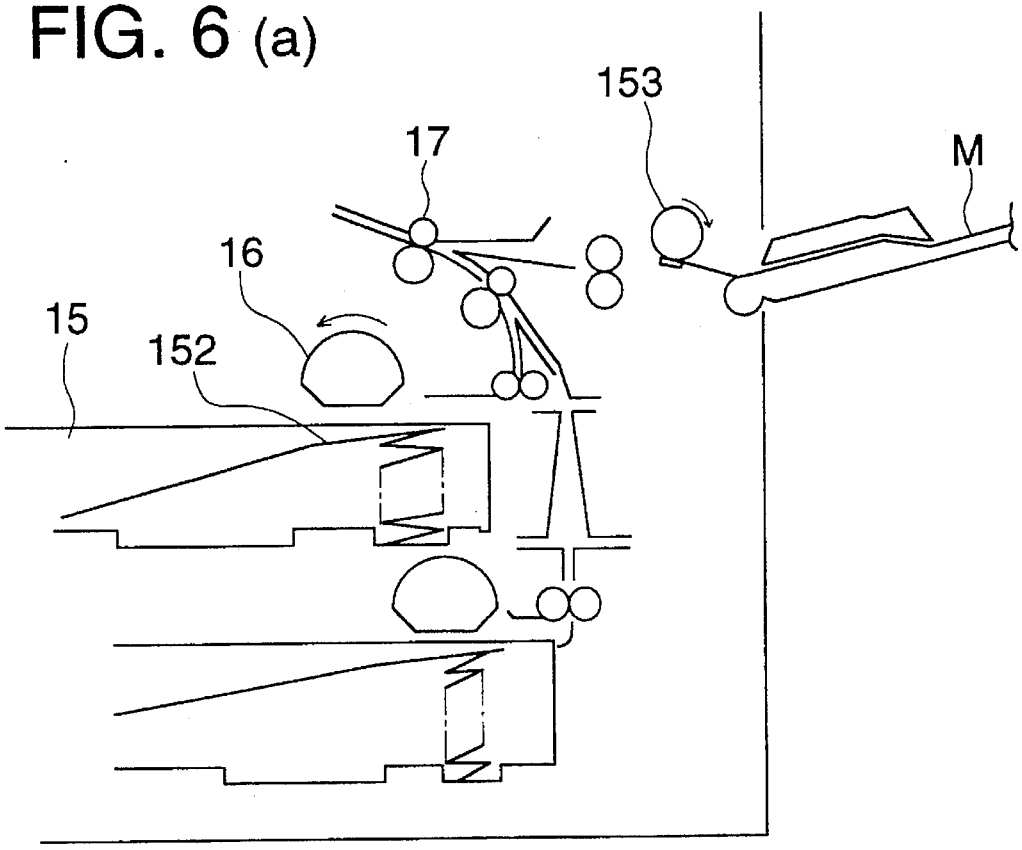
FIGS. 6(*a*) and 6(*b*) are views showing a main portion of a sheet feed section.
Figure 6:
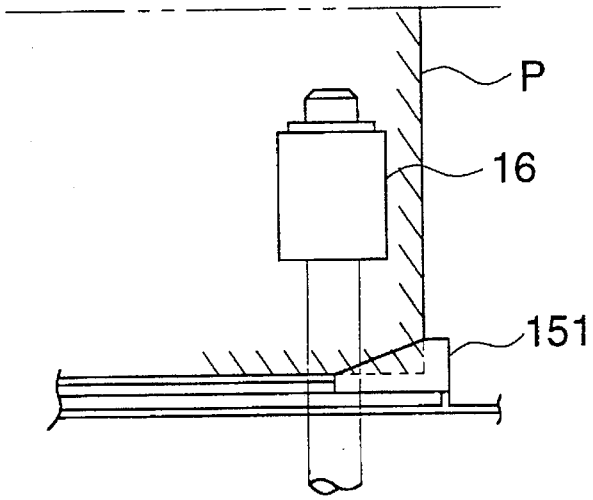

FIG. 6 shows a sheet feed section of the recording sheet P, which is loaded in the sheet feed cassette 15 in such a manner that one side of the recording sheet P is used as the reference position. Accordingly, an operation claw 151 is provided on only the reference side of the recording sheet P. Further, a semicircular roller 16 is structured by a cantilever structure, and is positioned near the reference side of the recording sheet P.

The sheet feed section has a motor for its exclusive use. When the semicircular 16 is rotated in the direction of the arrow, it conveys only the uppermost sheet of the recording sheets P, which are stacked on a push up plate 152, with the operation claw 151.

The recording sheet P, conveyed from the sheet feed cassette 15, takes a U-turn along the conveyance path. Immediately after the leading edge of the recording sheet P passes through the sheet feed rollers 17, the motor is temporarily stopped when passage of the leading edge of the recording sheet P is detected by a sheet feed sensor, not shown. After that, the motor is started again when transferring operations are appropriately timed, and the recording sheet P is fed to the transfer area while keeping a predetermined angle with respect to the photoreceptor surface.

On the other hand, the recording sheet can be manually fed from a manual feeding tray M which is located on the front surface of the apparatus main body.

The manual-fed sheet is conveyed by the rotation of a pick-up roller 153, and conveyed to the transfer area through the same process as that of the foregoing sheet feeding from the sheet feed cassette 15.

The manually feed sheet is a commonly used recording sheet P such as 16 lb sheets and 24 lb sheets, 36 lb thick sheets, transparency sheets for OHP, or the like. When the manual feeding tray M is detached from, and an exclusive use feeder is optionally assembled to the apparatus, envelopes can also be fed manually.

Transferring

Figure 7:
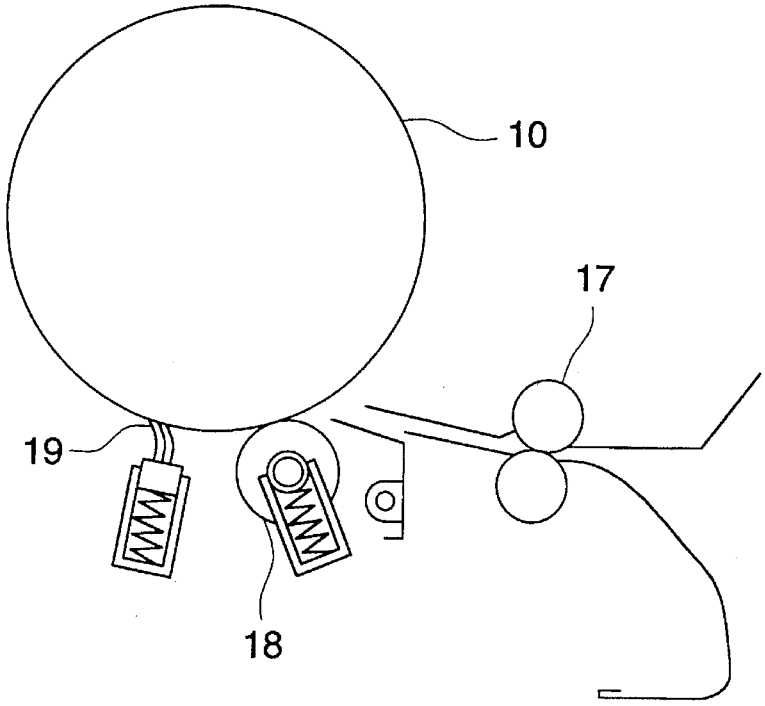
FIG. 7 is a view showing a main portion of a transfer section.

The position of the transfer roller 18 is adjustable with respect to the peripheral surface of the photoreceptor drum 10. When a mono-color image is printed, the transfer roller 18 is always in pressure-contact with the peripheral surface of the photoreceptor drum 10 as shown in FIG. 7. However, while a color image is being formed, the transfer roller 18 is withdrawn and separated from the peripheral surface of the photoreceptor drum 10, and comes into pressure-contact with the peripheral surface of the photoreceptor drum 10 only at the time of transferring. A separation brush 19 is in closely timed relationship with the change of position of the transfer roller 18, and comes into pressure-contact with the peripheral surface of the photoreceptor drum 10 and is then separated from the surface of the drum.

In the apparatus of this example, the transfer roller 18, onto which a voltage of +3 to +4 KVDC is applied, and the surface of which is cleaned by a blade, is used. The separation brush 19 is used, onto which a bias voltage, in which a DC voltage is superimposed on an AC voltage, is applied.

Fixing

Figure 8:
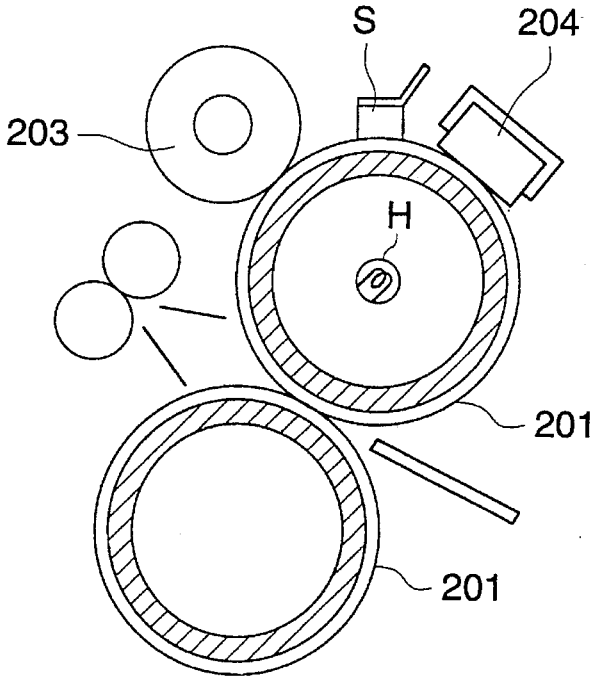
FIG. 8 is a view showing a main portion of a fixing unit.

The fixing device 20 of the apparatus of this example is a so-called heat roller type fixing device composed of a pair of rollers as shown in FIG. 8. The recording sheet P is heated and conveyed by a nip portion formed between an upper roller 201, in which a heater is housed, and which is rotated clockwise, and a lower roller 202, which is in pressure-contact with the upper roller 201 and driven thereby. Then, the toner image is fused.

Heat resistant tubes are coated on the upper and lower rollers, and when the nip portion is formed in a preferable shape by the pressure-contact with each other, wrinkles of the sheet surface, which are easily formed at the time of conveyance of envelopes, or the like, can be prevented.

The temperature of the peripheral surface of the upper roller 201 is detected by a temperature sensor, and controlled so that the temperature is maintained within a predetermined temperature range. Smudges adhering to rollers due to fusing of toner are removed by the pressure-contact of a cleaning roller 203. This cleaning roller 203 is replaced with the a new cleaning roller after about 40,000 printing cycles. A fixing heater is controlled under the consideration to save energy such that the operation mode of the heater changes to the SLEEP mode, when non-use time exceeds a predetermined period of time.

When an OHP transparency is used as a transfer material, silicone oil is coated over the roller surface by a oil pad 204 provided on the surface of the upper roller 201 so that the toner image surface is smoothed and irregular reflection is prevented in order to increase the transmission factor of a color toner image.

Accordingly, when the conveyance speed of the transfer material is switched to 3 steps of 100 mm/sec, 50 mm/sec and 12.5 mm/sec, the apparatus in this example can have a mode in which 3 types of transfer materials such as normal sheets, envelopes and transparencies can be used, and can be used for various purposes.

The setting temperature of the upper roller 201 can be lowered to about 180° C. when a lower temperature fusing toner is used. Further, when a sponge material (porous PTFE coating) is used for the oil pad 204, uneven pressure is eliminated, and uniform oil coating can be realized.

Suppressing the speed fluctuations of the photoreceptor drum 10 in the first example of the present invention is performed as follows.

Figure 9:
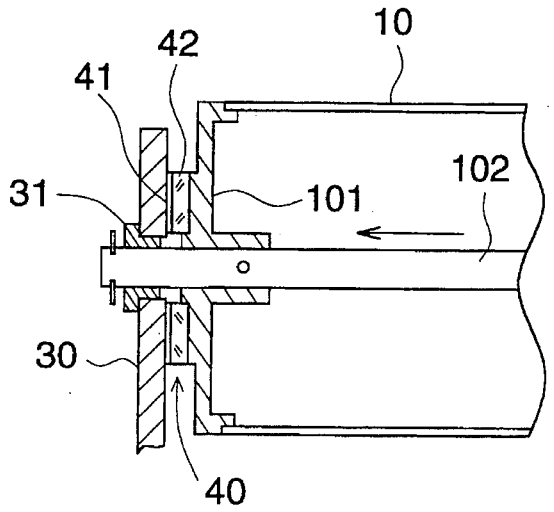
FIG. 9 is a sectional view of a main portion showing an example of an arrangement of a sliding member according to the first example.

FIG. 9 is a sectional view showing the supporting structure of the side surface of the driven side of the photoreceptor drum 10 which is the side shown by arrow A in FIG. 3.

A ring-shaped sliding member 40 is fixed on the outer surface of a flange 101 which supports one end of the photoreceptor drum 10. The sliding member 40 comes into pressure-contact with the inner surface of the cartridge 30, to which the surface of the sliding member is opposed, by a thrust in the arrowed direction, caused by the drive of the helical gear G, and is in sliding-contact with the inner surface, during rotation of the drum 10. This pressure-contact force due to the thrust of the helical gear G is applied in the same way as that in the example shown in FIGS. 12(*a*) through 12(*f*), which will be described later.

Figure 10:
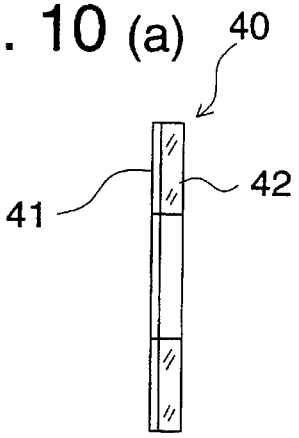
FIGS. 10(*a*) and 10 (*b*) are sectional views of sliding members.
Figure 10:
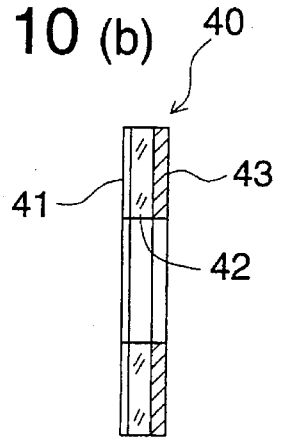

It can be considered that the sliding member 40 is independently composed of a viscoelastic layer which is fixed on the flange 101 side. Further, a sliding member 40 can be used which is composed of a surface layer 41, which comes into contact with the cartridge 30 side, and the viscoelastic layer 42, which is fixed onto the flange 101 side, as shown in FIG. 10(*a*). Alternatively, a sliding member 40 can be used, in which a base layer 43 is further provided onto the viscoelastic layer 42 for reinforcement.

The surface layer 41 is applied to protect the viscoelastic layer 42, and to provide a sliding property to the surface. In the case where the sliding member 40 is in sliding contact with the inner surface of the cartridge 30, the following surface layer is used which has an appropriate hardness and friction coefficient for a braking effect of the sliding member itself and smooth driving of the photoreceptor drum 10.

The viscoelastic layer 42 is used to absorb speed fluctuations, generated when the photoreceptor drum 10 is driven, by its viscoelasticity, and to reduce the absolute value of speed fluctuations. A high polymer member having the desired viscosity and elasticity is used for the viscoelastic layer 42.

The base layer 43 is used as necessary in the relationship between dimensions of the photoreceptor drum 10 and the cartridge 30, and in the relationship between the amount of deformation of the viscoelastic layer 42 and the pressing force of the viscoelastic layer 42 onto the inner surface of the cartridge 30 due to its deformation. That is, when the pressing force onto the inner surface of the cartridge 30 is large, a larger torque is required to drive the photoreceptor drum 10, and the motor m is relatively largely burdened therewith. When the pressing force is smaller, the speed fluctuations are barely reduced, and therefore, desired effects are not realized.

Accordingly, the thickness of the viscoelastic layer 42 is determined by considering the amount of deformation. The necessity or unnecessariness of the base layer 43 is determined by the relationship between dimensions of the photoreceptor drum 10 and the cartridge 30, and then the thickness of the base layer is determined.

Specifically, a wear resisting resin sheet having a small friction coefficient is suitable for the surface layer, a foaming resin member such as urethane resin, silicone resin, or the like, is suitable for the viscoelastic layer 42, and a hard resin plate is suitable for the base layer 43. As an example, a member which is laminated in the following thickness rate and integrated with each other, is used for the sliding member, and fixed onto the flange 101 with a double coated adhesive tape or adhesives.

EXAMPLE 1

Surface layer: 10 to 100 μm

Viscoelastic layer: 5 mm

EXAMPLE 2

Surface layer: 50μm

Viscoelastic layer: 6 mm

Base layer: 3 mm

Figure 11:
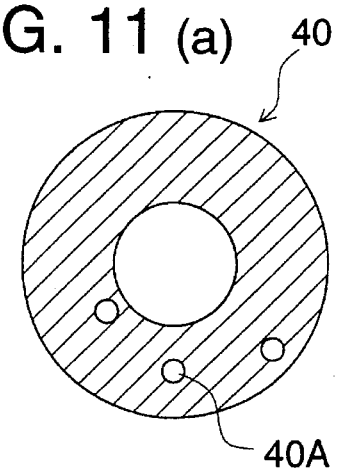
FIGS. 11(*a*) and 11(*b*) are plan views of the sliding members.
Figure 11:
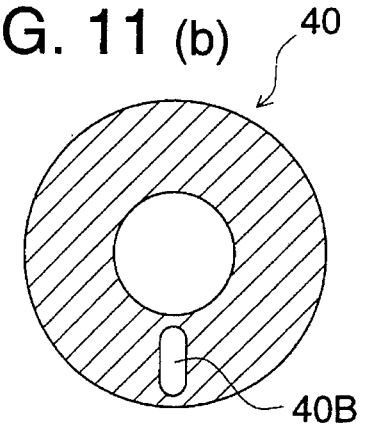

Further, when each sliding member 40 is provided with through holes or recessed portions such as round holes 40A or a long hole 40B in the circumferential direction as shown in FIG. 11, dust or foreign matter, introduced onto the contact-sliding surface, is removed into the through holes or recessed portions and the surface is always cleaned, and thereby, the frictional force generated between the sliding member and the cartridge 30 can be maintained constant.

Figure 15:
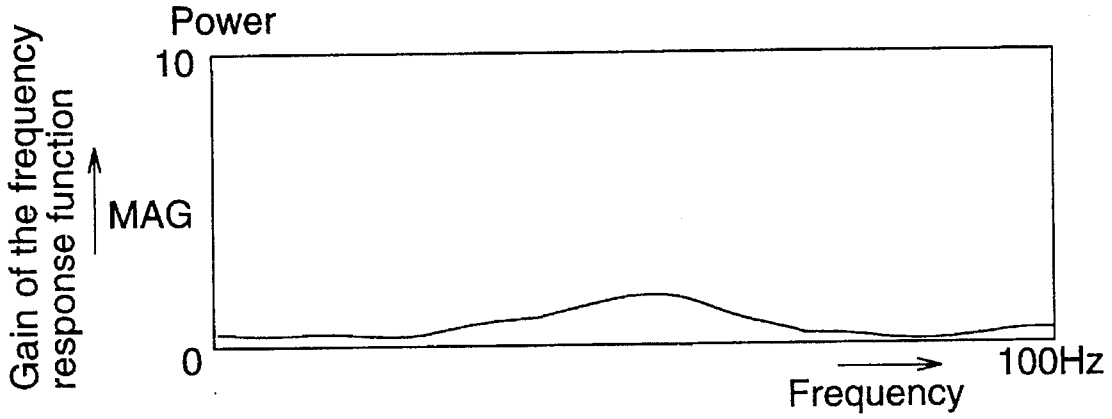
FIGS. 15(*a*) and 15(*b*) are graphs showing power spectrums of speed fluctuations of the photoreceptor and transfer functions of the driving system in the present invention.
Figure 15:
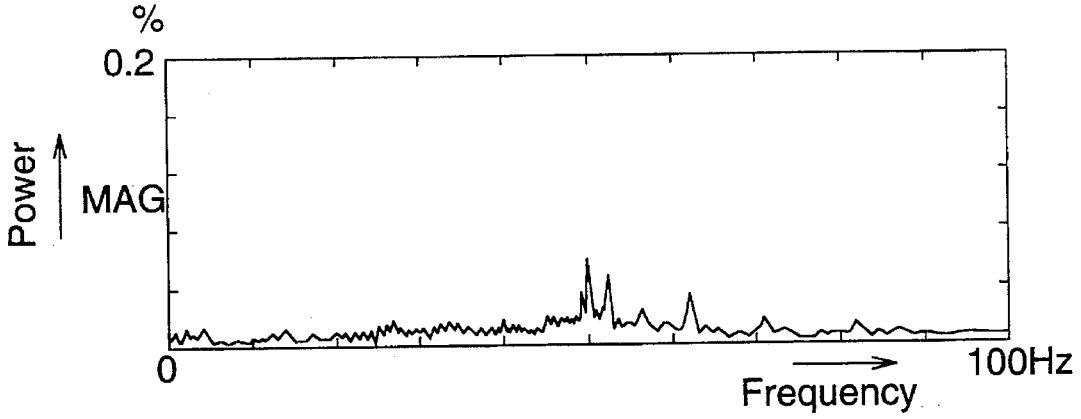

When the sliding member 40 is used, large fluctuation components in the speed fluctuations of the photoreceptor drum 10 are eliminated as explained in FIG. 15, and the peak of the frequency response function is also lowered, so that the photoreceptor drum can be rotated at a stable speed.

Figure 12:
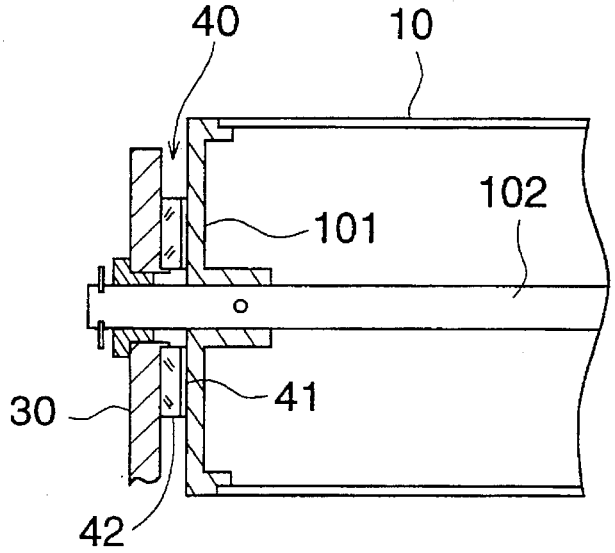
FIGS. 12(*a*), 12(*b*) and 12(*c*) are sectional views of main portions showing examples of the arrangement of the sliding member according to the first example.
Figure 12:
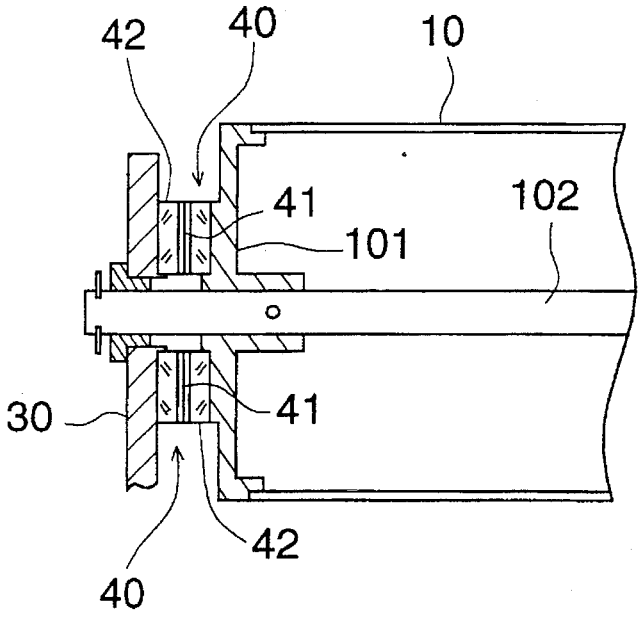
Figure 12:
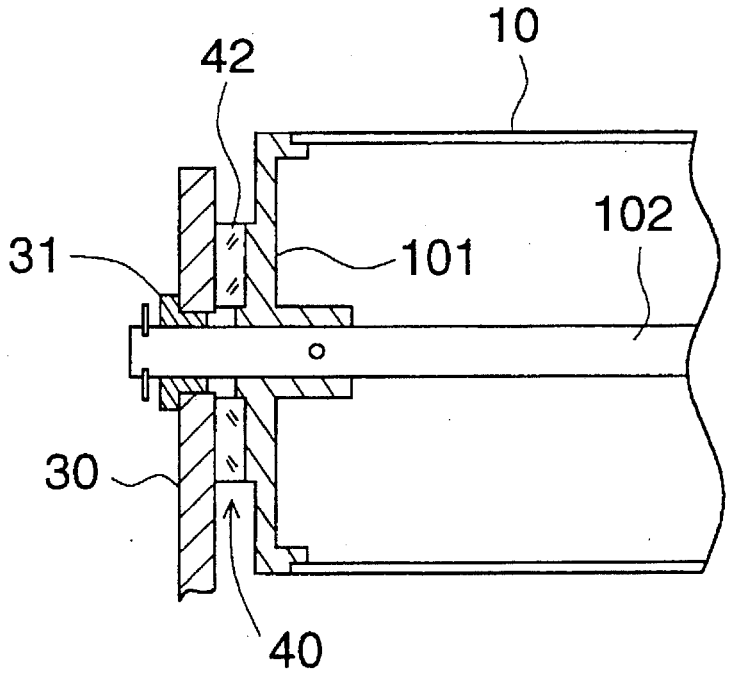
Figure 12:
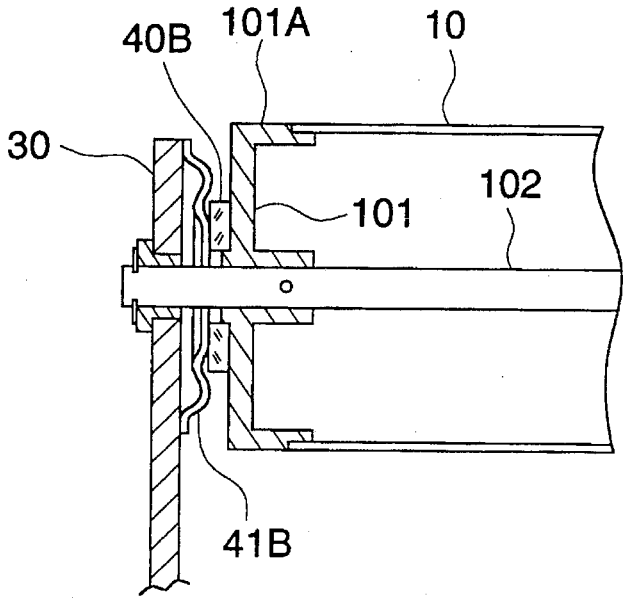
Figure 12:
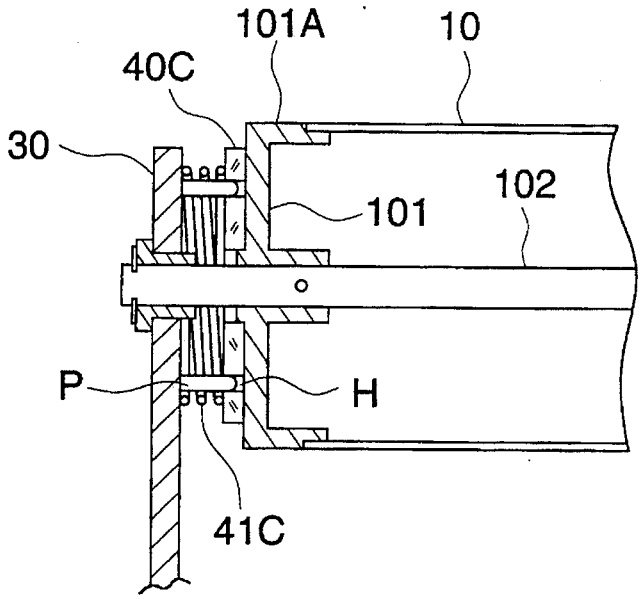
Figure 12:
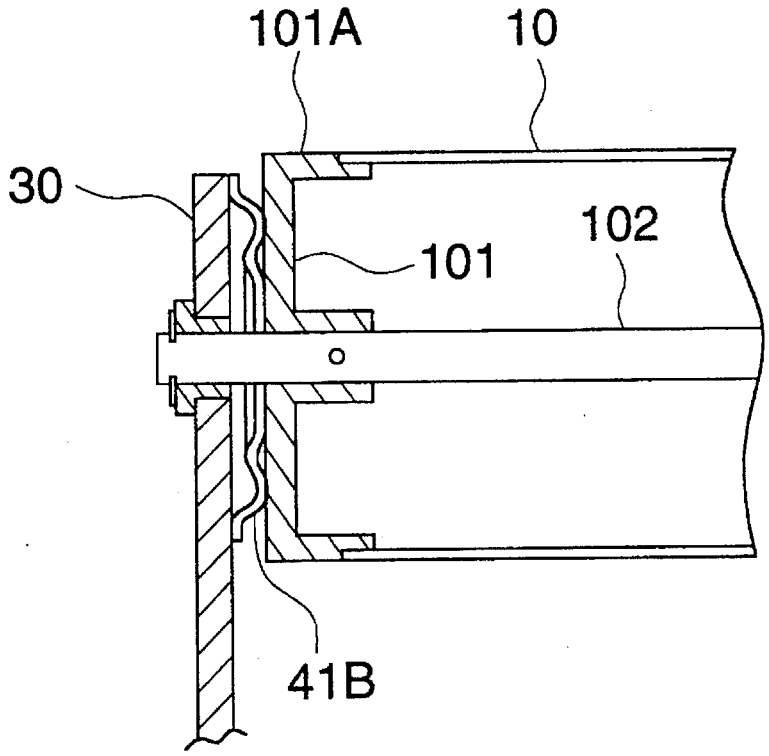

The sliding member 40 may be structured so that it is fixed on the inner surface of the cartridge 30 and the surface layer 41 slides in contact with the outer surface of the flange 101 of the photoreceptor drum 10 as the sliding surface as shown in FIG. 12(*a*). Further, the same effects can be obtained when the sliding member 40 is structured so that two sliding members are respectively fixed onto the surface of the flange 101 and the surface of the cartridge 30, which are opposite to each other, as shown in FIG. 12(*b*), and their surface layers slide in contact with each other. Still further, the surface layer may be integrally structured with the viscoelastic layer 42 as shown in FIG. 12(*c*).

The suppression of the speed fluctuations of the photoreceptor drum 10 in the second example of the present invention is carried out as follows.

FIG. 12(*d*) shows an example in which a disk spring 41B, on which concentric protrusions and recesses are formed, is used instead of the leaf spring 41A as the elastic member, and FIG. 12(*e*) shows an example in which a compression type coil spring 41C is used as the elastic member.

A sliding member 40, which has a sliding surface 101A having the diameter a little larger than that of the photoreceptor, and which is supported by the cartridge 30, comes into pressure-contact with the flange 101, which supports the side end of the photoreceptor drum 10, and slides in contact with the flange surface when the drum is rotated.

A material, in which resin material such as urethane or silicone is dipped in fiber body and molded, and which has a larger attenuation effect with respect to speed fluctuations, can be used as the sliding member 40. This member comes into pressure-contact with the photoreceptor drum 10 by the stable spring force of the leaf spring 41A, and an attenuation action is produced by the friction force, so that effects for suppressing the speed fluctuations can be realized.

The sliding member 40 can decrease load fluctuations by the same amount as that of the decrease in steady state speed fluctuations. For example, in an example shown in FIG. 16, when the thickness of the sliding member is more than 3 mm, the steady state fluctuation ratio decreases to approximately 50%. When a load fluctuation of about 10% occurs at that time, it can be expected that the load fluctuation decreases to approximately 5%. However, when the value of the driving torque of the driving system of the photoreceptor increases, it is necessary to also increase the motor capacity required in this system. Accordingly, there is a possibility that the motor capacity becomes too large. Therefore, it is necessary to strike a balance between motor specifications and effects.

Figure 16:
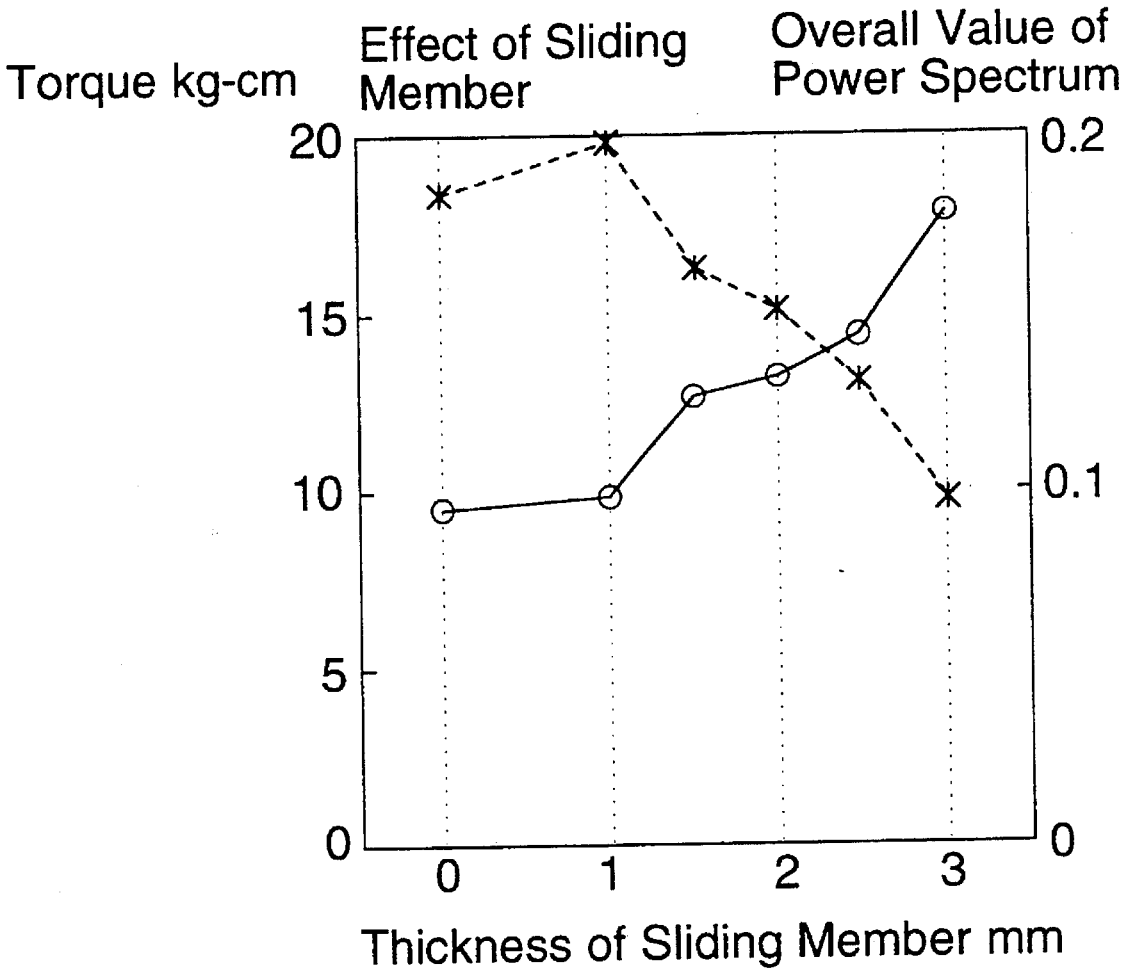
FIG. 16 is a graph for explaining the relationship between the thickness of the sliding member and the sliding effects.

In FIG. 16, the right vertical axis shows values of torque of the photoreceptor driving system as the thickness of the braking member is changed. At the same time, the left vertical axis shows overall values of the power spectrum so that the driving accuracy can be evaluated.

Any speed fluctuations of the photoreceptor drum 10 is suppressed as follows. The rotation shaft 102 of the photoreceptor drum passes through the disk spring 41B, the coil spring 41C and respective ring-shaped sliding members 40B and 40C which are sandwiched between the flange 101 and the cartridge 30. Each sliding member comes into pressure-contact with the outer surface of the flange 101 by the spring action of each spring, and slides in contact with the surface when the photoreceptor drum is rotated, so that its speed fluctuations are suppressed.

When spring constants of respective leaf spring 41*a*, disk spring 41B and coil spring 41C are converted into the torsional rigidities around the rotation shaft 102 of the photoreceptor drum 10 and defined as K, the inertial moment around the rotation shaft 102 is defined as I, and the number of natural vibrations around the rotation shaft of the photoreceptor drum 10 at the time of no sliding member is defined as f, then, the following relationship is obtained.

$K > (2\pi f)^2 I$

When the spring constant is determined so that the above relationship is satisfied, the pressing force corresponding to vibration characteristics of the photoreceptor drum 10 can be applied to each sliding member, so that attenuation effects of vibrations of the photoreceptor drum 10 can be obtained by the frictional force of the sliding member.

Specifically, when the coil spring 40C is used as the elastic member, the following measure is taken. A pair of locking pins are set on the cartridge side 30, and are engaged with pin holes H of the sliding member 40. Thereby, the sliding member 40 is prevented from being rotated when the photoreceptor drum 10 is rotated, and the torsional rigidity of the coil spring 40C can be maintained.

The attenuation effects of vibration by each sliding member are as follows. When a viscoelastic sliding member is used, vibrations are decreased in geometrical series. In contrast to this, when a solid sliding member is used, the vibrations are decreased in arithmetical series, however, because the pressing force of each spring member is stable, effective attenuation effects of vibrations can be maintained for a longer period of time. Further, as shown in FIG. 12(*f*), a structure, in which the disk spring 41B itself performs as a sliding member, can be applied to the apparatus.

Figure 13:
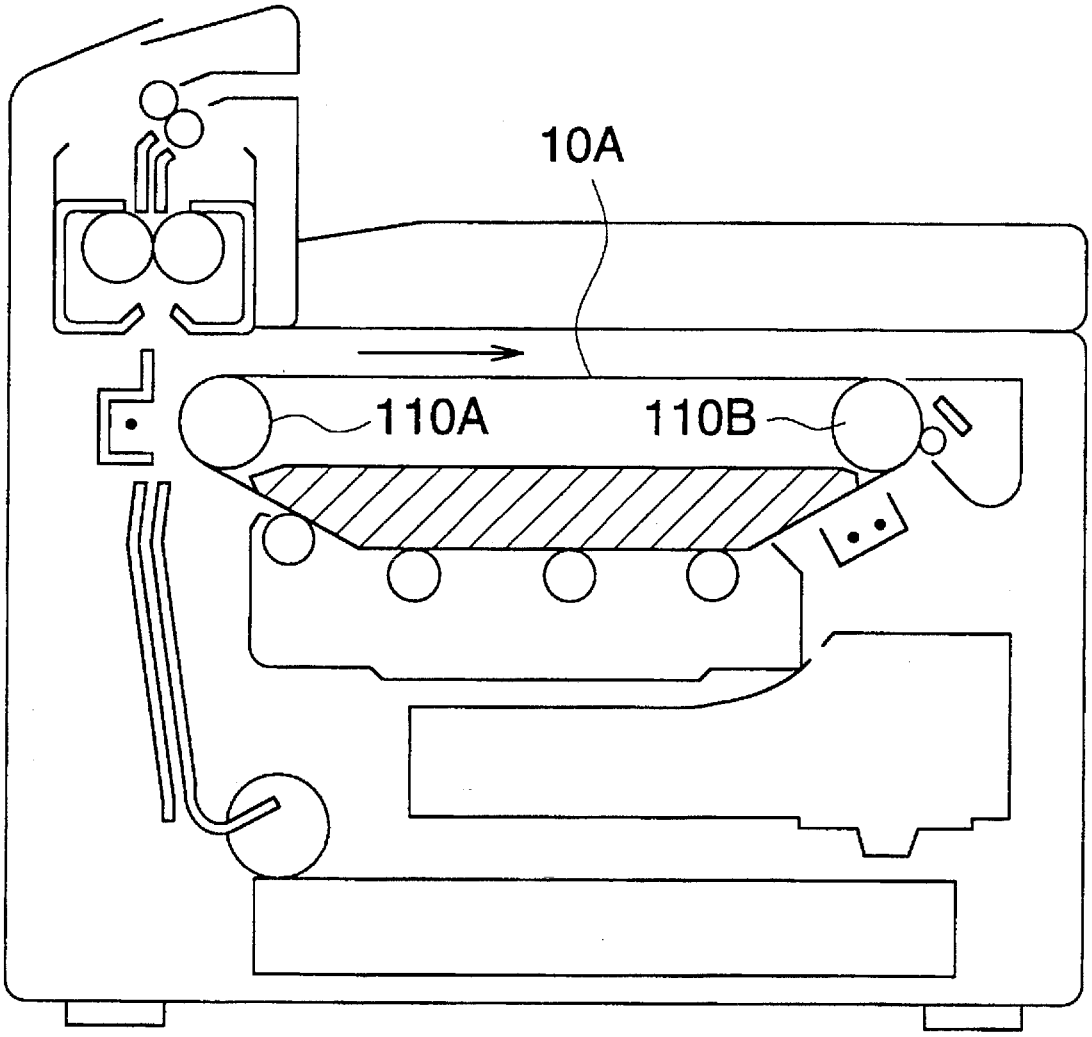
FIG. 13 is a view showing an example of a structure of the image forming apparatus using a belt-shaped photoreceptor.
Figure 14:
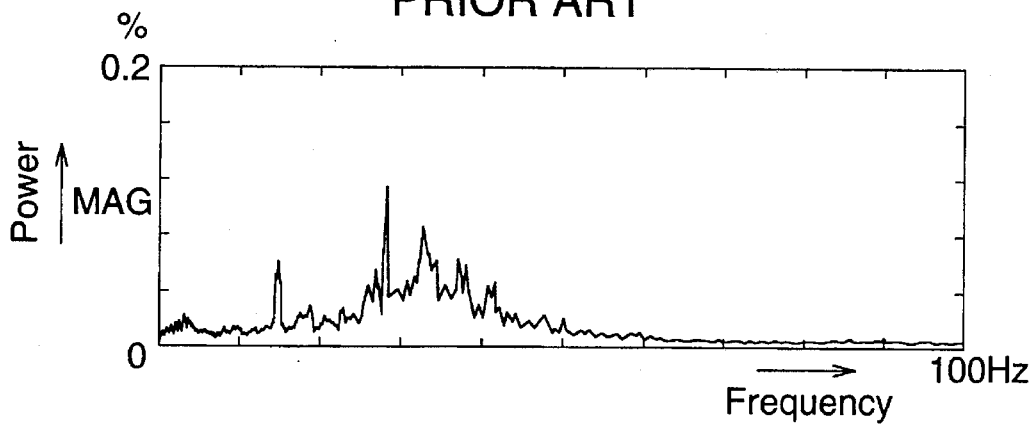
FIG. 14 (a) PRIOR ART
FIGS. 14(*a*), 14(*b*) and 14(*c*) are graphs showing power spectrums of speed fluctuations of the photoreceptor and transfer functions of a driving system in a conventional apparatus.
Figure 14:
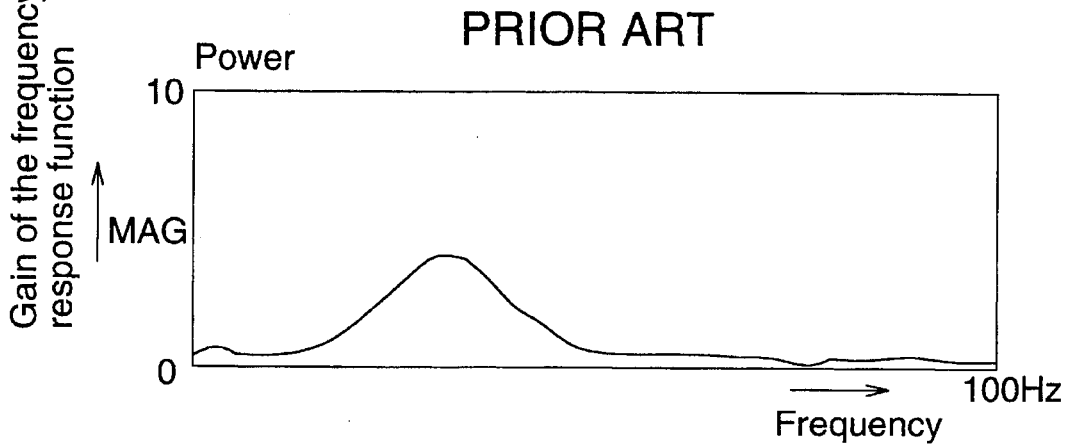
FIG. 14 (b) PRIOR ART
Figure 14:
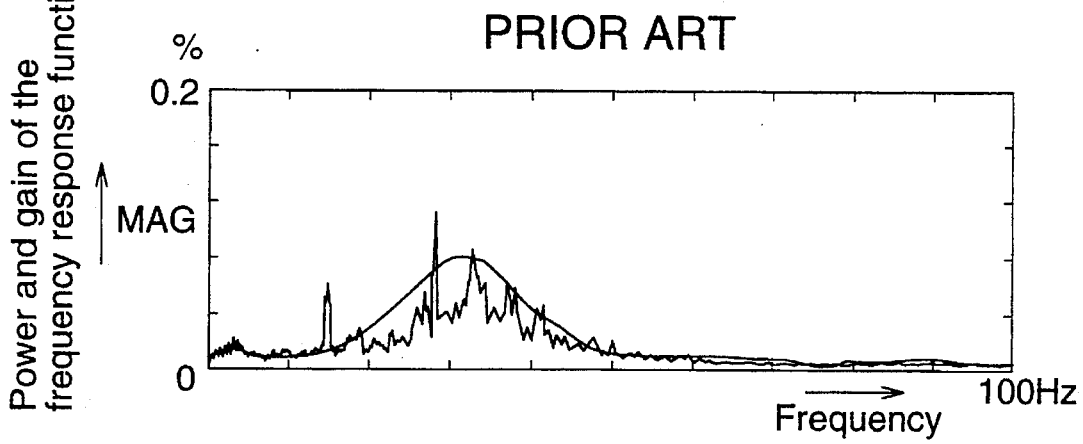
FIG. 14 (c) PRIOR ART

In this connection, although an image forming apparatus, in which a drum-shaped photoreceptor is used, was explained in the first and second examples, the present invention can also be applied to an image forming apparatus in which a belt-shaped photoreceptor 10A, which is stretched between rollers 110A and 110B and conveyed in rotation as shown in FIG. 13, is used. In this case, each sliding member 40 is attached to the roller on the driving side, for example, the drive roller 110A so that the sliding member 40 comes into pressure-contact with the roller 110A.

When the sliding member comes into contact with the side surface of the photoreceptor as explained in the first and the second examples, the following effects can be obtained.

① When the sliding member comes into contact with the surface of the photoreceptor, the shaft of the photoreceptor is subject to a bending moment, and a force, by which the rotational accuracy of the photoreceptor is adversely affected, is applied onto the shaft.

In contrast to this, when the sliding member comes into contact with the side surface of the photoreceptor, because an uniform force is always applied onto the surface, the photoreceptor is not subject to the above-described force.

② When the sliding member comes into contact with the surface of the photoreceptor, the contact condition of the sliding member is changed due to the straightness or eccentricity of the photoreceptor surface, and accordingly, in one portion, a strong braking force may be applied, and in another portion, a weaker braking force may be applied. However, when the sliding member comes into contact with the side surface of the photoreceptor, the uniform contact condition can be always obtained.

③ When the sliding member comes into contact with the surface of the photoreceptor, because the contact portion is limited to the non-image portion, the dimension of the contact portion is limited. Accordingly, in order to obtain an area in which desired effects are obtained, it is necessary to greatly increase the dimension (the length) of the photoreceptor, and thereby, the dimensions of the apparatus are also greatly increased. Further, although many sliding can be attached onto the non-image portion, the structure of the apparatus would become greatly complicated (Japanese Patent Publication Open to public Inspection No. 56397/1995, and others). In contrast to this, when the sliding member is provided onto the side surface of the photoreceptor, normally, a sufficient area can be secured.

According to the present invention, even when the photoreceptor is subject to vibrations specific to the driving system or load fluctuations at the time of image formation, the photoreceptor is always driven and rotated at a constant peripheral speed. As the result, the uneven density and the uneven color, which specifically occur in the subsidiary scanning direction of the writing system, are greatly reduced, and an image forming apparatus capable of recording a high quality image can be provided by the present invention.

What is claimed is:

1. An image forming apparatus, comprising:

a photoreceptor, having a side surface and a circumferential surface, for forming an image on said circumferential surface thereof:

a driving means for driving said photoreceptor;

a sliding member for decreasing steady state speed fluctuations of said photoreceptor; and an elastic member for pressing said sliding member onto said side surface of said photoreceptor.

2. The apparatus of claim 1, wherein said sliding member and said elastic member are configured uniformly.

3. The apparatus of claim 1, wherein said elastic member is a spring member.

4. The apparatus of claim 3, wherein said spring member is a leaf spring member.

5. The apparatus of claim 3, wherein said spring member is a coil spring member.

6. The apparatus of claim 1, wherein said elastic member is a viscoelastic member.

7. The apparatus of claim 6, wherein said viscoelastic member is a foaming resin member.

8. The apparatus of claim 1, wherein said driving means drives said photoreceptor so as to impel said photoreceptor toward said sliding member.

9. The apparatus of claim 8, wherein said driving means drives said photoreceptor through a helical gear so that a thrust of said helical gear creates a pressure-contact force to impel said photoreceptor toward said sliding member.

10. An image forming apparatus, comprising:

a photoreceptor, having a side surface and a circumferential surface, for forming an image on said circumferential surface thereof:

a driving means for driving said photoreceptor;

a sliding member for decreasing steady state speed fluctuations of said photoreceptor;

an elastic member for pressing said sliding member onto said side surface of said photoreceptor, and a cartridge for accommodating at least said photoreceptor drum, said sliding member, and said elastic member.

11. The apparatus of claim 10, wherein said sliding member and said elastic member are configured uniformly.

12. The apparatus of claim 10, wherein said elastic member is a spring member.

13. The apparatus of claim 12, wherein said spring member is a leaf spring member.

14. The apparatus of claim 12, wherein said spring member is a coil spring member.

15. The apparatus of claim 10, wherein said elastic member is a viscoelastic member.

16. The apparatus of claim 15, wherein said viscoelastic member is a foaming resin member.

17. The apparatus of claim 10, wherein said driving means drives said photoreceptor so as to impel said photoreceptor toward said sliding member.

18. The apparatus of claim 17, wherein said driving means drives said photoreceptor through a helical gear so that a thrust of said helical gear creates a pressure-contact force to impel said photoreceptor toward said sliding member.

19. An image forming apparatus, comprising:

a photoreceptor belt for forming an image on a surface thereof:

a drive roller means, having a side surface and a circumferential surface, for supporting said photoreceptor belt suspended on said circumferential surface;

a driving means for driving said driving roller means;

a sliding member for decreasing steady state speed fluctuations of said photoreceptor belt; and an elastic member for pressing said sliding member onto said side surface of said drive roller means.

20. The apparatus of claim 19, wherein said sliding member and said elastic member are configured uniformly.

21. The apparatus of claim 19, wherein said elastic member is a spring member.

22. The apparatus of claim 21, wherein said spring member is a leaf spring member.

23. The apparatus of claim 21, wherein said spring member is a coil spring member.

24. The apparatus of claim 19, wherein said elastic member is a viscoelastic member.

25. The apparatus of claim 24, wherein said viscoelastic member is a foaming resin member.

26. The apparatus of claim 19, wherein said driving means drives said photoreceptor so as to impel said driving roller means toward said sliding member.

27. The apparatus of claim 26, wherein said driving means drives said driving roller means through a helical gear so that a thrust of said helical gear creates a pressure-contact force to impel said driving roller means toward said sliding member.

* * * * *